United States Patent [19]

Tomooka

[11] Patent Number: 4,621,610

[45] Date of Patent: Nov. 11, 1986

[54] SOLID FUEL HEATING APPARATUS

[76] Inventor: Walter K. Tomooka, 143 W. Powers Cir., Littleton, Colo. 80120

[21] Appl. No.: 696,652

[22] Filed: Jan. 31, 1985

[51] Int. Cl.[4] ..... F24C 1/14

[52] U.S. Cl. ..... 126/61; 126/77; 126/83; 126/126

[58] Field of Search ..... 126/77, 83, 60, 61, 126/66, 67, 65, 121, 123, 126; 110/210; 237/55, 51

[56] References Cited

U.S. PATENT DOCUMENTS

| | | | |
|---|---|---|---|
| 328,809 | 10/1885 | Rew | 126/77 |
| 884,309 | 4/1908 | Bigler | 126/83 |
| 1,713,573 | 5/1929 | Verdin et al. | 126/59 |
| 1,873,767 | 8/1932 | Kahn | 126/58 |
| 1,944,626 | 1/1934 | Allbert | 126/121 |
| 2,475,120 | 7/1949 | Young | 126/72 |
| 2,703,567 | 3/1955 | Manchester et al. | 126/121 |
| 3,096,754 | 7/1963 | Howrey | 126/120 |
| 3,749,078 | 7/1973 | Dupler | 126/121 |
| 3,808,986 | 5/1974 | Logdon | 110/210 |
| 3,952,721 | 4/1976 | Patterson | 126/63 |
| 4,015,581 | 4/1977 | Martenson | 126/121 |
| 4,050,441 | 9/1977 | Horwinski | 126/121 |
| 4,056,091 | 11/1977 | Moncrieff-Yeates | 126/121 |
| 4,074,679 | 2/1978 | Jensen | 126/121 |
| 4,095,581 | 6/1978 | Billmeyer et al. | 126/121 |
| 4,127,100 | 11/1978 | Baker | 126/66 |
| 4,131,105 | 12/1978 | Moncrieff-Yeates | 126/121 |
| 4,136,662 | 1/1979 | Willson | 126/61 |
| 4,157,704 | 6/1979 | Zimmer | 126/62 |
| 4,178,908 | 12/1979 | Trexler, Sr. | 126/121 |
| 4,184,473 | 1/1980 | McIntire et al. | 126/77 |
| 4,192,285 | 3/1980 | Nietupski | 126/83 |
| 4,201,185 | 5/1980 | Black | 126/77 |
| 4,204,517 | 5/1980 | Rumsey | 126/63 |
| 4,207,860 | 6/1980 | Schrock | 126/77 |
| 4,207,861 | 6/1980 | Buckner | 126/83 |
| 4,212,286 | 7/1980 | Shane et al. | 126/77 |
| 4,215,668 | 8/1980 | Holcombe et al. | 126/60 |
| 4,226,224 | 10/1980 | Milligan | 126/83 |
| 4,232,650 | 11/1980 | Frank | 126/77 |
| 4,240,403 | 12/1980 | Bader | 126/67 |
| 4,265,213 | 5/1981 | Gorsuch et al. | 126/66 |
| 4,265,215 | 5/1981 | Curry | 126/77 |
| 4,304,215 | 12/1981 | Jarman | 126/121 |
| 4,316,444 | 2/1982 | Gullickson | 126/77 |
| 4,328,784 | 5/1982 | Cox | 126/67 |
| 4,338,913 | 7/1982 | Good | 126/77 |
| 4,342,306 | 8/1982 | Thulman et al. | 126/61 |
| 4,343,288 | 8/1982 | Tjosvold | 126/77 |
| 4,361,131 | 11/1982 | Homolik | 126/123 |
| 4,385,620 | 5/1983 | Black | 126/77 |
| 4,404,953 | 9/1983 | Thulman et al. | 126/77 |
| 4,422,437 | 12/1983 | Hirschey | 126/77 |
| 4,426,992 | 1/1984 | Martenson | 126/77 |
| 4,432,335 | 2/1984 | Kilham | 126/77 |
| 4,445,496 | 5/1984 | Crain | 126/77 |
| 4,465,055 | 8/1984 | Bortz | 126/123 |
| 4,469,083 | 9/1984 | Helle et al. | 126/61 |
| 4,471,752 | 9/1984 | Halchek | 126/77 |
| 4,475,533 | 10/1984 | Milligan | 126/77 |

FOREIGN PATENT DOCUMENTS

| | | | |
|---|---|---|---|
| 1058465 | 7/1979 | Canada . | |
| 1076441 | 4/1980 | Canada . | |
| 1088831 | 11/1980 | Canada . | |
| 1092923 | 1/1981 | Canada . | |
| 1094902 | 2/1981 | Canada . | |
| 1995360 | 2/1981 | Canada . | |
| 1125129 | 6/1982 | Canada . | |
| 1146036 | 5/1983 | Canada . | |
| 1148049 | 6/1983 | Canada . | |
| 1166911 | 5/1984 | Canada . | |
| 3012827 | 10/1981 | Fed. Rep. of Germany | 126/77 |

*Primary Examiner*—James C. Yeung

*Attorney, Agent, or Firm*—Fleit, Jacobson, Cohn & Price

[57] ABSTRACT

A solid fuel heating apparatus has combustion air supplied in a controlled manner by a manifold. The manifold has a first branch that directs combustion air to the interior of the fuel ignited within the firebox and a second branch that extends along the forward edge of a baffle that extends from the rear wall of the firebox across a flue. Air issuing from the second branch is directed towards the fuel within the firebox so that a bodily rotation of gases within the firebox is obtained. A third branch extending generally parallel to the second branch is also provided and directs air towards the first branch. The air delivered by the second and third branch is roughly twice that delivered by the first branch and it has been found that this provides complete combustion of the fuel within the stove.

38 Claims, 6 Drawing Figures

SOLID FUEL HEATING APPARATUS

The present invention relates to solid fuel heating apparatus.

It is well-known to burn a solid fuel such as wood or coal in a heating apparatus such as a stove, fireplace or furnace to provide heat. It is also well recognized that fireplaces or stoves that permit the passage of large quantities of air through the combustion area are relatively inefficient and accordingly steps have been taken to develop so called "air tight" stoves. These stoves attempt to limit the air passing through the stove to that required for combustion of the fuel within the stove. Despite many attempts to improve the efficiency of these stoves their performance is still less than optimum.

Accordingly, it is an object of the present invention to obviate or mitigate the above disadvantages and provide a heating apparatus having improved thermal efficiency.

In general terms, the present invention provides a heating apparatus in which the flow of air to a firebox within the apparatus is supplied at a number of locations through a manifold. A baffle is also provided to inhibit direct egress of combustion by-products an improved air to a flue and the inlets for the combustion air located such that gas conbustible gas mixture is obtained and bodily rotation of the combustion by-products is generated within the firebox. This provides an intense combustion temperature that effectively gasifies the fuel and combusts the gases within the firebox and promotes improved combustion efficiency.

Embodiments of the invention will now be described by way of example only with reference to the accompanying drawings in which FIG. 1 is a general perspective view of a stove, FIG. 2 is a view on the line 2—2 of FIG. 1.

Figure 1:
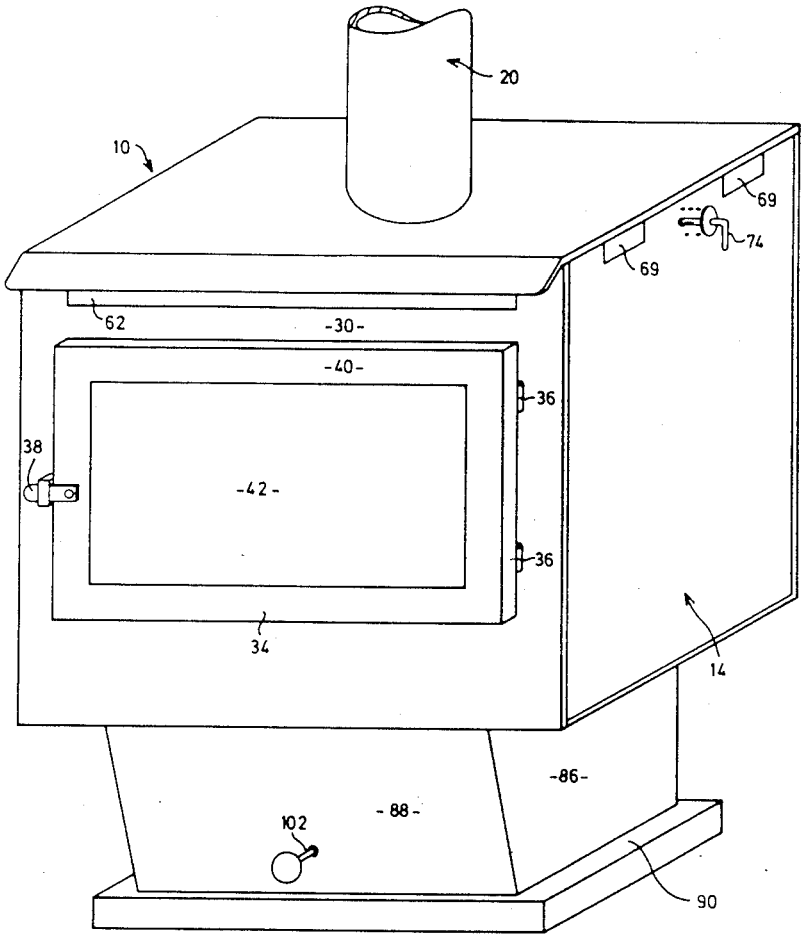
Figure 2:
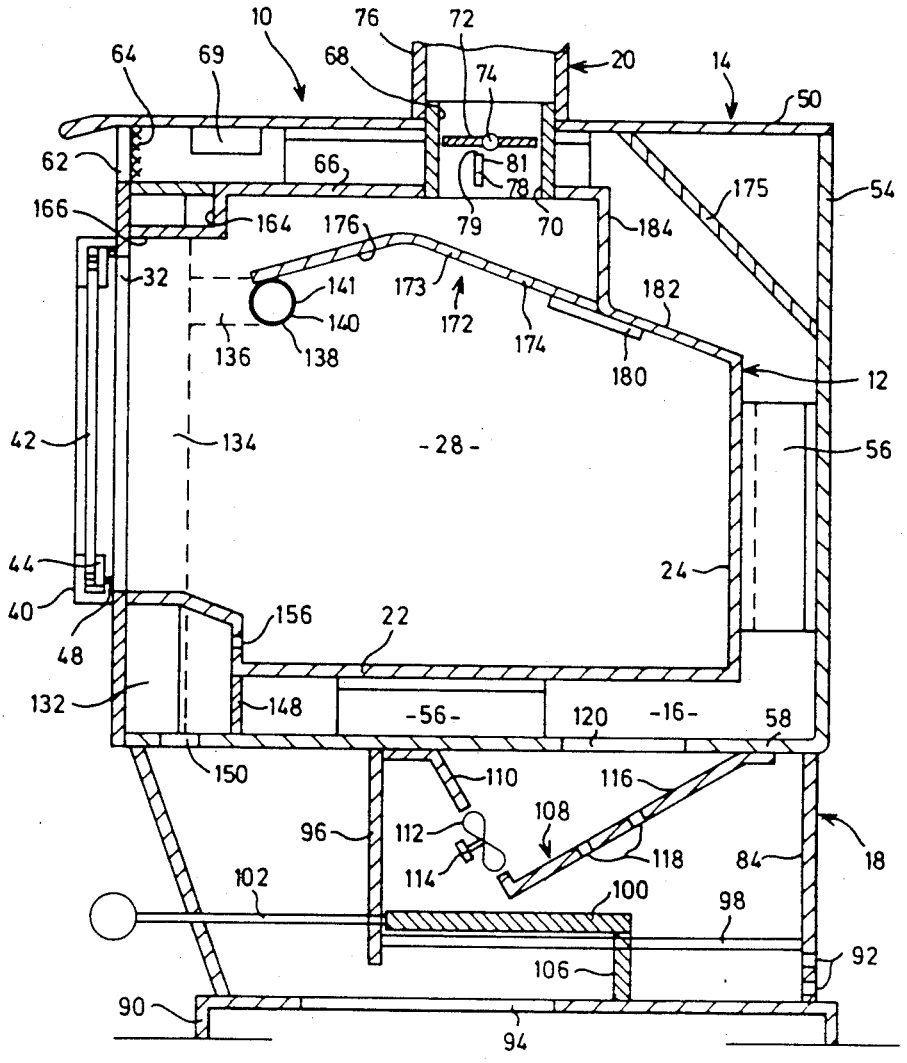
Figure 3:
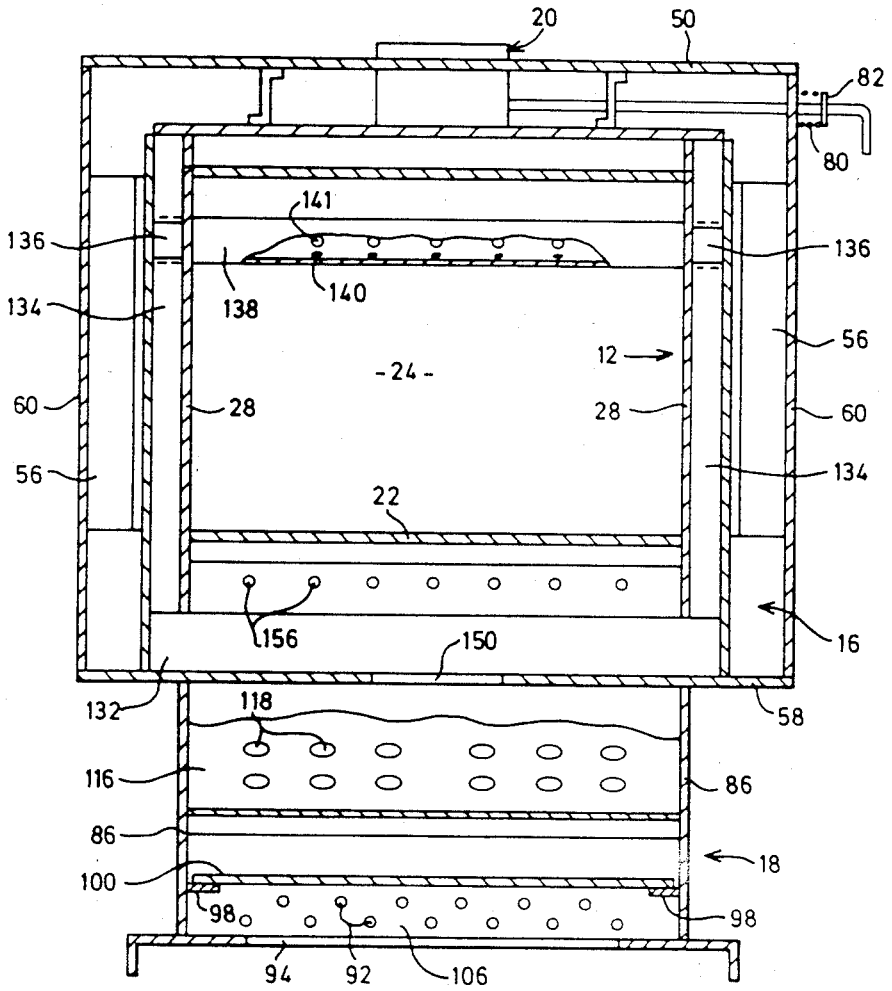
FIG. 3 is a view on the line 3—3 of FIG. 2.
Figure 4:
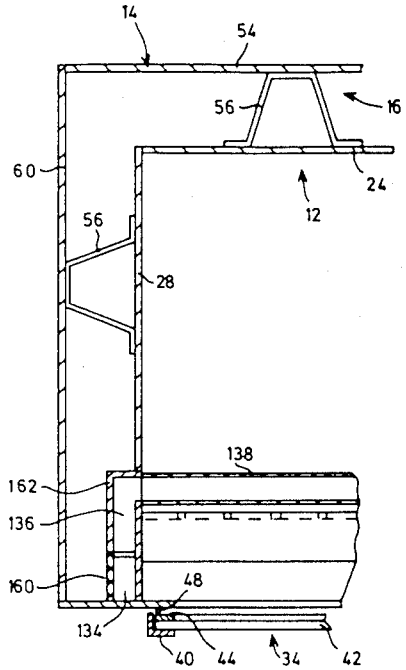
FIG. 4 is a view on the line 4—4 of FIG. 2.
Figure 5:
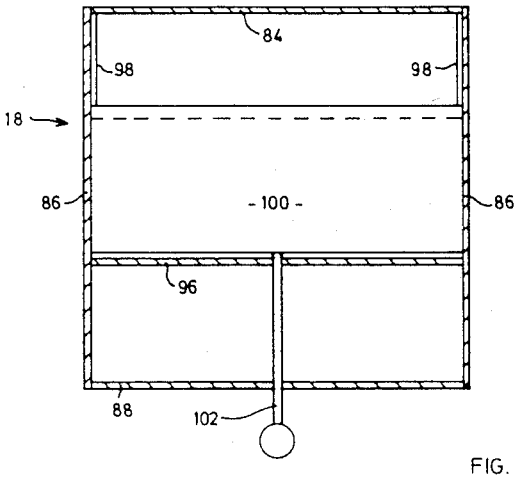
FIG. 5 is a view on the line 5—5 of FIG. 2.

Referring now to the drawings, a stove generally designated 10 comprises a firebox 12 located within a jacket 14 that is maintained in spaced relationship from the firebox 12 to provide an air passage 16 around the firebox. The jacket 14 is mounted upon a plinth 18 that acts as a plenum chamber for the supply of air to the firebox and to the passage 16. By-products of combustion are removed from the firebox 12 through a flue 20.

The firebox 12 comprises a base 22 upon which fuel is supported, a rear wall 24, a roof 26, and side walls 28 that extend between the roof 26 and base 22 and are welded along the seams to provide an airtight structure. The roof 26, base 22 and side walls 28 are welded to a face plate 30 forming the front of the stove 10. An aperture 32 is formed in the face plate 30 and a door assembly 34 mounted on the face plate 30 by hinges 36. A latch 38 acts between the face plate 30 and the door assembly 34 to secure the door assembly 34 in a closed position.

The door assembly 34 is formed from a metal frame 40 within which is located a transparent panel 42 formed from a transparent ceramic material such as that sold under the trade name "NEOCERAM" (Trade Mark). The edge of the panel 42 is wrapped with a fiberglass tape and a retaining frame 44 attached through bolts 46 to the door frame to maintain the panel in position. A gasket 48 formed from fiberglass rope is located between the door frame 40 and the retaining frame 44 so as to provide an air tight seal against the face plate 30 when the door is in a closed position.

The front panel 30 extends beyond the roof 26, side walls 28 and base 22 for connection to the jacket 14. The jacket 14 includes a top 50 extending generally parallel to the roof 26, a back 54 extending parallel to the rear wall 24 and a bottom wall 58 extending parallel to the base 22. Spacers 56 are located between the firebox 12 and jacket 14 to maintain them in spaced relationship. The forward edges of top 50 and the bottom wall 58 are welded to the upper and lower edges respectively of the face plate 30. Side walls 60 are provided to enclose the jacket 14 and are welded to the vertical edges of the face plate 30 to provide an enclosed structure.

An aperture 62 is provided in the face plate 30 between the roof 26 and top 50 to allow air travelling through the passage 16 to flow out into the room in which the stove is located. A grill 64 is provided to prevent access to the interior of the passage 16 through the aperture 62. The upper edges of side walls 60 are also relieved to provide air outlets 69 to distribute air from the passage 16.

The top 50 and roof 26 are provided with circular ports 66, 68 respectively that are coaxial and receive a flue collar 70. The collar 70 is welded to the periphery of each of the ports to ensure that combustion by-products cannot enter the passage 16. The upper edge of the collar 70 is formed with a bayonet fastening of conventional structure that allows a prefabricated pipe 76 to be attached to the collar in an air tight manner.

Located in the collar 70 is a damper plate 72 mounted on a spindle 74 that extends laterally in the passage 16 and through spacers 52 and side wall 60. A stop 78 formed from an elongate bar is welded to the interior of collar 70 slightly to one side of spindle 74. The stop 78 has a top edge 79 that is positioned to abut the undersurface of damper plate 72 when it is in the horizontal or closed position and a flank 81 positioned so that the damper 74 abuts it when the plate 72 is in a vertical or open position. In this manner, rotation of the damper plate 72 is limited to 90° . Resistance to rotation of the spindle 74 is provided by a tension spring 80 acting between a pair of washers 82 mounted on the spindle 74 outside of the jacket 14 to hold the damper plate 72 against the inside of the collar 70.

The plinth 18 comprises rear panel 84, side panels 86 and an inclined front panel 88 that extend around the periphery of the bottom wall 58 and are joined to a base plate 90. The rear panel 84 includes at its lower edge a series of holes 92 to provide an air inlet to the interior of the plinth 18. The front panel 88 is detachable and provides access within plinth 18 for maintenance. The base plate 90 is also provided with an aperture 94 that may be connected through the floor to a duct supplying air from the exterior of the building within which the stove is located.

A partition plate 96 depends from the bottom wall 58 and extends across the width of the plinth 18 between the side walls 86. The plate 96 is also detachable from the bottom wall 58 to allow access to the interior of the plinth 18 for maintenance. Slide members 98 extend rearwardly from the lower edge of the partition plate 96 to the rear wall 18 and are secured to the side walls 86 to support a valve plate 100. A control rod 102 is attached to the forward edge of the valve plate 100 and extends through the front face 88 for manipulation by the user of the stove.

Projecting upwardly from the base plate 90 is a divider 106 that extends between the side walls 86 of the plinth. The upper edge of the divider 106 engages the underside of the valve plate 100.

Mounted above the valve plate 100 on the underside of the bottom wall 58 is a fan shroud member 108. The fan shroud 108 comprises a front inclined panel 110 that includes a pair of apertures 112 in which fan assemblies 114 are mounted. Extending rearwardly from the lower edge of the front inclined panel 110 is a rear panel 116 in which is formed a number of holes 118. Located between the front and rear edges of the shroud 108 is an elongate slot 120 formed in the bottom wall 58 to allow air to pass into the passage 16.

The interior of the plinth 18 serves as a plenum chamber and the valve plate 100 is therefore able to direct air from either of the inlets 92 or 94 through the fan assemblies 114 and into the passage 16. The fan assemblies are provided with conventional electrical controls to allow them to be modulated as desired. The apertures 118 provide a by pass in the event that the fan is not operating to ensure continuing passage of air around the firebox 12 and avoid excessive temperatures within the passage 16.

Figure 6:
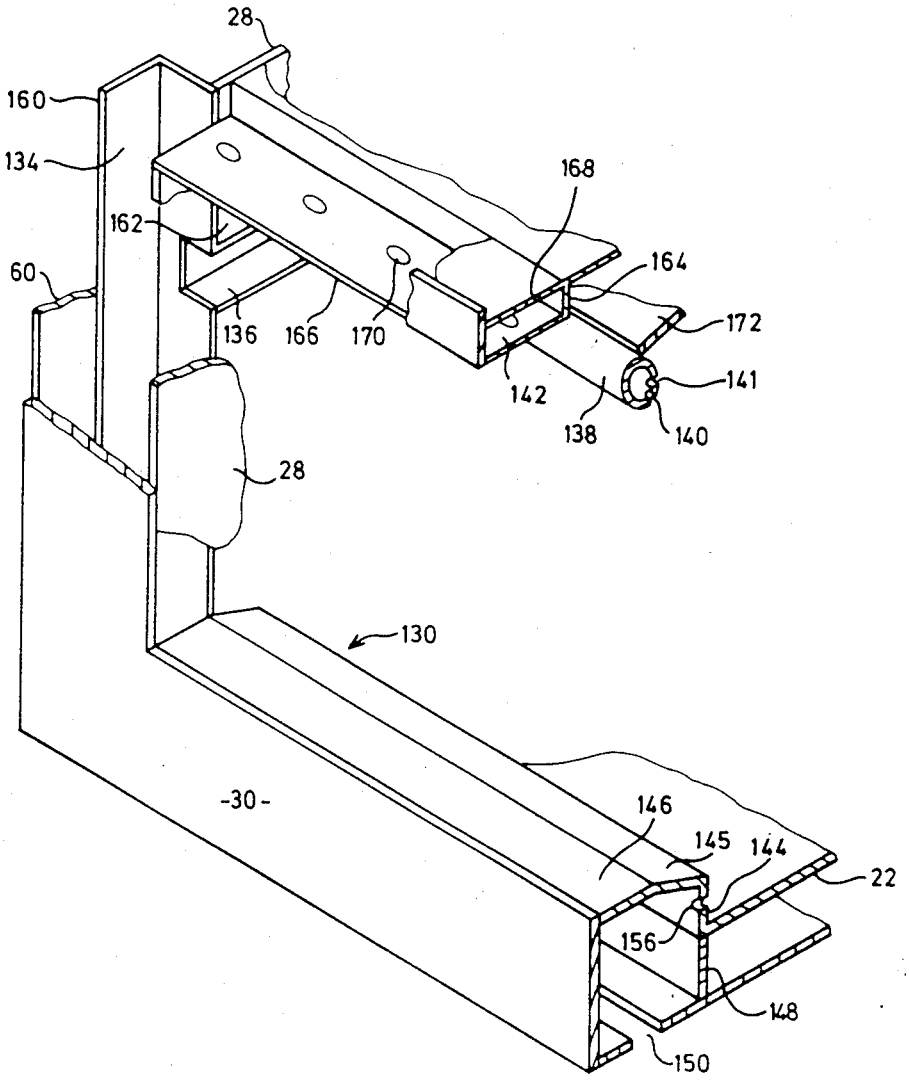
FIG. 6 is a perspective view of a portion of the stove shown in FIG. 2 with portions thereof removed for clarity.

To achieve controlled combustion of fuel within the firebox 12, air from the interior of the plinth 18 is also directed through a manifold assembly 130 to the interior of the firebox 12 to support combustion. As may best be seen in FIG. 6, the manifold includes a first branch indicated generally at 132 that extends laterally across the front edge of the firebox 12. The first branch 132 extends into a pair of vertical ducts 134 located on the exterior surface of the side wall 28 of the firebox 12. Passageways 136 communicate with the interior of the duct 134 to convey air to opposite ends of a pipe 138 that extends between apertures in the side walls 28 of the firebox 12 and constitutes the second branch of the manifold. The ducts 134 also connect with opposite ends of a third branch 142 of the manifold that extends laterally across the firebox between the side walls 28, but adjacent the roof panel 26.

The first branch 132 is generally rectangular in shape and is formed between the face plate 30, base 22 and bottom panel 58. The base 22 is jogged adjacent the face plate 30 to provide a vertical section 144 and a horizontal section 146 interconnected by a sloped section 145 to prevent accumulation of ash. The horizontal section 146 is welded to the face plate 30 adjacent the periphery of the aperture 32 and a vertical plate 148 is welded between the base 22 and bottom panel 58 as an extension of the vertical section 144. A rectangular aperture 150 is formed in the bottom panel 58 between the face plate 30 and the vertical panel 148 to convey air from the interior of the plinth 18 to the interior of the manifold 30.

Air within the first branch of the manifold 130 enters the interior of the firebox 12 through an outlet defined by a series of circular holes 156 that are spaced along the vertical portion 144. Air also passes along the first branch to the vertical ducts 134.

The vertical ducts 134 are formed by an angle member 160 that is welded at the junction of the face plate 30 and side panels 28 to define a generally rectangular cross-section for the duct 134.

The passageway 136 is formed from a channel 162 that is welded onto the exterior of the side panel 28 and intersects one flange of the angle member 160. A suitable blanking piece (not shown) is welded to the opposite end of the channel 162 to the angle piece 160 to close the channel and to direct air into the interior of the tube 138.

Air from the interior of tube 138 is directed to the interior of the firebox 12 through an outlet constituted by two sets of holes 140, 141. The holes 140 are directed generally downwardly and rearwardly with the axis of the holes intersecting the vertical at an angle of 20° . The axis of holes 141 is horizontal so that air is directed toward the rear wall 24. The third branch 142 is formed in a manner similar to that of the first branch 132 in that the roof panel 26 is jogged to provide a vertical portion 164 and a horizontal portion 166. The horizontal portion 166 is welded to the face plate 30 and a horizontal filler plate 168 welded between the vertical section 164 and the face plate 30 to define a generally rectangular cross-section for the third branch 142. A series of spaced circular holes 170 are provided in the horizontal portion 166 to provide an outlet for air in the third branch 142.

Air may thus flow from the interior of the plinth through the slot 150 into the first branch 132 and from there may be distributed through the ducts 134 and passages 136 into the second and third branches respectively.

Located within the firebox 12 and supported at its forward edge on the tube 138 is a baffle 172. The baffle 172 is formed by a plate 173 with a concave undersurface 174 provided by a pair of mutually inclined portions 176, 178. The rear edge of the portion 178 is supported on a ledge 180 that extends from an inclined portion 182 of the rear wall 24 that constitutes a portion of the baffle 172. The rear wall 24 continues with a vertical extension 184 that intersects the roof panel 26 to the rear of the port 68. The baffle 172 extends across the port 68 and thus prevents the direct egress of by-products of combustion from the 175 fuel supported on the base 22 to the flue 20. An air flow deflector 175 is positioned within the passage 16 across the corner formed between the rear wall 54 and the top panel 50 so that air in the passage follows more closely the contour of the rear panel 24.

In operation, fuel is ignited on the base 22 and the door assembly 34 closed. Air to support combustion is thus drawn through the mainfold 130 and into the firebox 12. The holes 156 in the first branch 132 of the manifold direct air towards the rear wall 24 and thus into the interior of the fuel supported on the base 22. The rear wall 24 and the baffle 172 direct by-products of combustion toward the front wall where the holes 140 are orientated so that the combustion by-products are deflected towards the base 22. Similarly the holes 170 in the horizontal section 166 of the third branch 142 direct the gaseous by-products of the fuel toward the base 22 so that the by-products are directed back into the fuel supported on the base plate 22.

The action of the streams of air and baffle imparts a bodily rotation of the by-products while injecting needed oxygen back into the combustion region of the fuel supported on the plate 22. Holes 141 are orientated so that air issuing from the holes 141 is directed against the flow of the gaseous by-products thus promoting turbulence and thorough mixing of the gases. This produces an extremely intense and efficient form of combustion. The air issuing from the holes 170 also wash the rear surface of the transparent panel 42 and therefore keep it clear of deposits from the combustion process. Some of the gaseous by-products spill over the front edge of the baffle to exit from the flue 20, but the supply of air from the first and second branches ensures ignition of most of the combustible gases prior to egress through the flue.

The valve 100 may be used to direct air to the passage 16 from either the interior of the building in which the stove is located by way of inlet 92 or from the exterior of the building through inlet 94. The combustion air is always drawn from the exterior of the building through the aperture 150 and into the manifold.

Because the branches of the manifold are interconnected, it is possible to achieve a balance between the air flow from the first, second and third branches. The second and third branches are in parallel to one another, but in series with the first so that control of air entering the first branch also controls air entering second and third branches. In a prototype of the stove, it has been found that the correct balance of the air flows from each outlet is provided by forming the holes 156 with a diameter of $\frac{3}{8}''$ and spaced at centres of 2.8393 inches. The holes 170 are formed with a diameter of 5/16 inch and located on centres of 2.0. This is for a stove having an overall width of $19\frac{7}{8}''$.

The holes 140, 141 are each 7/32 inch diameter and located at centres of $2\frac{1}{4}$ inches. The two central holes straddle the centreline so that a total of 16 holes are provided, 8 for holes 140 and 8 for holes 141.

With this configuration the area of the outlet provided by holes 156 in the first branch is 0.6627 sq. inches; the area of the outlet in the second branch provided by holes 140, 141 is 0.7670 sq. inches and the area of the outlet in the third branch provided by the holes 170 is 0.6013 sq. inches. With this configuration air supplied by the first branch is 32.63% and that provided by the second and third branches is 67.37%. This approximates to the proportion of gas constituents and solids obtained when pyrolising wood and suggests that the air is being distributed in correct proportion to obtain efficient combustion of both the gases and solids found in the fuel.

The configuration of the baffle 172 is also significant in obtaining optimum combustion. The baffle 172 is formed at an included angle of approximately 152° between the front and rear portions 176, 178. The inclined portion of the rear wall 24 extend at an angle of approximately 122° to the vertical portion of the rear wall 24. With this configuration it has been found that optimum retention of the gases occurs within the baffle 172 to assist in the overall high efficiency of the stove.

In operation, the stove appears to operate at a significantly higher temperature than that normally associated with wood burning stoves. The fuel supported on the base 22 appears to pyrolise and ignition of the gases driven from the wood occurs adjacent the outlets of the first and second branches so that combustion appears as plumes of flame from the holes in each of the branches of the manifold. It is believed that by carefully regulating the flow of oxygen to the interior of the firebox 12 and by insuring the mass flow of the oxygen is distributed in the correct proportion in the firebox through the careful sizing of the outlets in each of the branches, ignition of the cellulose within the wood can be inhibited while the pyrolisation continues.

It will be noted that the only control for air entering the manifold is the aperture 150 rather than the usual a variable valve that is normally provided. It has been found that the intensity of combustion can be regulated by the damper 72 indicating that the manifold is distributing the air in a controlled manner.

The manifold may be arranged in different configurations although the configuration shown in the drawings is preferred. For example, the first branch of the manifold can be formed in two parts extending along the side panels 28. In this manner the air from the first branch is still directed toward the interior of the fuel, but from each side rather than the front.

Alternatively, the first branch could be placed at the back of the base adjacent the junction of the rear wall and base 22. This produces an intense visual effect from the ignition of the gases within the firebox and may not therefore be acceptable to potential purchasers.

It may also be possible to omit the second branch of the manifold so that air supplied from the third branch imparts a bodily rotation to the gases. Again, whilst this results in improved performance over conventional wood stoves the embodiment shown in FIGS. 1 through 6 is preferred.

The angle of the baffle 172 may also be varied to alter the performance characteristics of the stove. The included angle between the front and rear portions 176, 178 can be adjusted and can, in fact, be made horizontal if desired. However, the flattening of the baffle tends to reduce the velocity of gases flowing across the baffle and this in turn requires increased combustion air.

The configuration of the back wall 24 with the inclined portion 182 and vertical portion 184 reduces a dead space behind the flue that would normally be occupied by relatively low temperature gases. In this way maximum heat transfer to air within the passage 16 is provided.

In the embodiment described above the spacing between the face plate 30 and rear wall 24 of the firebox are 16 9/16 inches and the distance between the base 22 and roof 26 is $16\frac{3}{8}$ inches. The length of the inclined portion of the rear face 182 was 2 9/16 inches and the intersection of the inclined portion 182 with a vertical portion of rear wall 24 occurred approximately 9 7/16 of an inch above the base 22. These dimensions are given by way of example only and are indicative of the size of firebox required when utilising a manifold having the outlet dimensions specified above. Obviously variations in these dimensions will require corresponding variations in the diameters of the holes providing the outlets in the manifold to ensure controlled combustion within the firebox.

I claim:

1. A solid fuel heating apparatus comprising an enclosed firebox having support means to support combustible fuel, a flue to allow egress of by-products of combustion from the firebox, means to permit placement of fuel within said firebox, a baffle extending partially across the firebox between said support means and said flue to inhibit the direct passage of combustion by-products from the support means to the flue, and air supply means to supply air to the interior of said firebox to support combustion therein, said air supply means including a manifold having a first branch to convey air to a location adjacent said support means with outlet means therein to direct air toward the interior of fuel on said support means, and a second branch connected to said first branch and located at an edge of said baffle means, said second branch having outlet means to direct air toward said support means, said outlet means and said baffle being configured to induce bodily rotation of said combustion by-products within said firebox during combustion of fuel on said support means.

2. A solid fuel heating apparatus according to claim 1 wherein said manifold includes a third branch to convey air to a location elevated from said first branch and having outlet means therein to direct air from said elevated location toward said first branch.

3. A solid fuel heating apparatus according to claim 2 wherein said means to permit placement of fuel is an aperture which is sealed by a door having a transparent panel therein and air from the outlet means of said third branch is directed across the interior surface of said panel.

4. A solid fuel heating apparatus according to claim 3 wherein said aperture is provided in a front face of said firebox and said baffle extends from a rear face toward said front face.

5. A solid fuel heating apparatus according to claim 2 wherein said outlet means in said respective branches are dimensioned to maintain the mass flow of air from respective branches in a predetermined ratio.

6. A solid fuel heating apparatus according to claim 5 wherein the outlet means of each branch include a plurality of outlets spaced apart along the respective branch to distribute uniformly the air issuing from the outlet means.

7. A solid fuel heating apparatus according to claim 6 wherein said second branch is serially connected with said first branch.

8. A solid fuel heating apparatus according to claim 7 wherein said third branch is connected in series with said first branch and in parallel to said second branch.

9. A solid fuel heating apparatus according to claim 8 wherein each branch extends laterally across said apparatus and said outlets comprise a plurality of apertures spaced apart along respective ones of said branches.

10. A solid fuel heating apparatus according to claim 7 wherein said firebox is located within a jacket having walls spaced from the exterior of said firebox to define a passage to permit the flow of air between the firebox and said jacket.

11. A solid fuel heating apparatus according to claim 10 wherein air is supplied between the firebox and jacket from a plenum chamber.

12. A solid fuel heating apparatus according to claim 11 wherein said manifold extends into said plenum for the supply of air thereto.

13. A solid fuel heating apparatus according to claim 12 wherein said plenum includes a pair of inlets, each of which is connected to a respective discrete source of air and valve means are provided to connect said passage to one or the other of said inlets.

14. A solid fuel heating apparatus according to claim 13 wherein fan means are located between said valve means and said passage to force air through said passage.

15. A solid fuel heating apparatus according to claim 14 wherein air flow means are provided to bypass said fan means and permit restricted flow from said inlets to said passage and thereby maintain air flow through said passage.

16. A solid fuel heating apparatus according to claim 15 wherein said fan means is mounted in a shroud and said air flow means are apertures formed in said partition.

17. A solid fuel heating apparatus according to claim 16 wherein said shroud is formed from a pair of surfaces disposed generally perpendicular to one another, said fan means being located in one of said surfaces and said air flow means being located in the other of said surfaces.

18. A solid fuel heating apparatus according to claim 1 wherein said baffle has concave undersurface directed toward said support means.

19. A solid fuel heating apparatus according to claim 18 wherein said baffle extends upwardly and outwardly from a rear vertical wall of said firebox.

20. A solid fuel heating apparatus according to claim 19 wherein said flue extends through an aperture in a roof portion of said firebox overlying said baffle.

21. A solid fuel heating apparatus according to claim 20 wherein a vertical panel extends from said roof portion adjacent said aperture to an upper surface of said baffle intermediate the front end rear edges thereof, a portion of said baffle thereby constituting a portion of the exterior wall of said firebox.

22. A solid fuel heating apparatus having a base, a roof spaced from said base, a front wall, a rear wall and a pair of laterally spaced side walls extending between said base and said roof to define an enclosed firebox, an aperture in said roof to receive a flue to allow egress of combustion products from the firebox, an opening in one of said walls to allow the Placement of fuel within said firebox, a door mounted on said one wall to seal said opening, a baffle extending from said rear wall toward front wall and across said aperture to deflect products of combustion flowing to said flue, said baffle being spaced from and said roof and having a forward edge spaced from said front wall to define a passage through which combustion by-products pass and air supply means to direct air to the interior of said firebox to support combustion of fuel therein, said air supply means including a manifold having a first branch located adjacent said base with an outlet therein to direct toward the interior of fuel combusting in said firebox and a second branch connected to said first branch and extending along said forward edge of said baffle, said second branch having an outlet therein to direct air toward said base, said air supply means and baffle cooperating to induce bodily rotation of combustion by-products in said firebox.

23. A solid fuel heating apparatus according to claim 22 wherein said first branch extends laterally across said firebox adjacent said front wall and said outlet therein directs air toward said rear wall.

24. A solid fuel heating apparatus according to claim 22 wherein said manifold includes a third branch located on said front wall opposite to said second branch, said third branch extending laterally across said firebox and having an outlet therein to direct air toward said base and generally parallel to said front wall.

25. A solid fuel heating apparatus according to claim 24 wherein said baffle extends upwardly from said rear wall.

26. A solid fuel heating apparatus according to claim 25 wherein said baffle has a concave undersurface directed toward said base.

27. A solid fuel heating apparatus according to claim 26 wherein said baffle has a rear portion sloping upwardly relative to said base and a front portion sloping downwardly relative to said base.

28. A solid fuel heating apparatus according to claim 24 wherein said rear wall includes a pair of spaced parallel vertical surfaces with an inclined surface extending upwardly toward said front wall to connect an upper edge of one of said vertical surfaces with a lower edge of the other of said vertical surfaces.

29. A solid fuel heating apparatus according to claim 28 wherein said baffle extends from said rear wall as a continuation of said inclined surface.

30. A solid fuel heating apparatus according to claim 29 wherein said baffle has a concave undersurface directed toward said base.

31. A solid fuel heating apparatus according to claim 30 wherein said baffle has a concave undersurface directed toward said base.

32. A solid fuel heating apparatus according to claim 28 wherein said aperture is located adjacent the junction of said other vertical surface and said roof.

33. A solid fuel heating apparatus according to claim 32 wherein said firebox is enclosed within a jacket maintained in spaced relationship from said firebox to permit air to flow between said jacket and said firebox.

34. A solid fuel heating apparatus according to claim 24 wherein said outlet is constituted by a plurality of holes uniformly spaced along each branch to provide a uniform distribution of air across said firebox.

35. A solid fuel heating apparatus according to claim 24 wherein said first branch is serially connected to said second and third branches.

36. A solid fuel heating apparatus according 35 wherein said third branch is connected in parallel to said second branch.

37. A solid fuel heating apparatus according to claim 36 wherein said manifold includes a pair of ducts each extending vertically between respective ends of said first branch and said third branch.

38. A solid fuel heating apparatus according to claim 37 wherein a passageway extends from each of said ducts to opposite ends of said second branch to convey air thereto.

* * * * *